US009342960B2

(12) United States Patent
Kim et al.

(10) Patent No.: US 9,342,960 B2
(45) Date of Patent: May 17, 2016

(54) METHOD AND APPARATUS FOR MANAGING ITEM LOTTERY SERVICE

(75) Inventors: Woon Yong Kim, Suwon-si (KR); Ki Cheol Jang, Seongnam-si (KR)

(73) Assignee: INTELLECTUAL DISCOVERY CO., LTD., Seoul (KR)

( * ) Notice: Subject to any disclaimer, the term of this patent is extended or adjusted under 35 U.S.C. 154(b) by 0 days.

(21) Appl. No.: 14/354,480

(22) PCT Filed: Oct. 26, 2011

(86) PCT No.: PCT/KR2011/008042

§ 371 (c)(1), (2), (4) Date: Apr. 25, 2014

(87) PCT Pub. No.: WO2013/062153

PCT Pub. Date: May 2, 2013

(65) Prior Publication Data

US 2014/0309009 A1 Oct. 16, 2014

(51) Int. Cl.

| | |
|---|---|
| ***A63F 9/24*** | (2006.01) |
| ***G07F 17/32*** | (2006.01) |
| ***G06Q 50/34*** | (2012.01) |

(52) U.S. Cl.

CPC ..... *G07F 17/329* (2013.01); *G06Q 50/34* (2013.01)

(58) Field of Classification Search

CPC ..... G07F 17/329; A63F 3/0645

See application file for complete search history.

(56) References Cited

U.S. PATENT DOCUMENTS

| | | | | |
|---|---|---|---|---|
| 5,380,007 | A * | 1/1995 | Travis et al. | 463/18 |
| 2004/0059659 | A1 * | 3/2004 | Safaei et al. | 705/35 |

FOREIGN PATENT DOCUMENTS

KR 10-2011-0027550 A 3/2011

OTHER PUBLICATIONS

International Preliminary Report on Patentability and English translation of Written Opinion issued in International Application No. PCT/KR2011/008042 on Apr. 29, 2014, 10 pages.

Bulletin board of Pmang homepage update, Pmang homepage Apr. 26, 2011, See p. 2 (URL: http://fifaonline.pmang.com/index.nwz?mKey=1&sKey=2#board/read/2/N/26994579/.

"FIFA online 2, Win of Blue capsule", Naver blog Jul. 22, 2011, See the drawings.(URL: http://www.cyworld.com/hong10000/12280161).

International Search Report issued in International Application No. PCT/KR2011/008042 on Jul. 25, 2012, 2 pages.

* cited by examiner

*Primary Examiner* — Steve Rowland

(74) *Attorney, Agent, or Firm* — Sughrue Mion, PLLC

(57) ABSTRACT

Provided is a technique which can increase user utilization of an item lottery service by providing users with an intuitive screen for the item lottery service, and, at the same time, a new source of fun. A method for managing an item lottery service in accordance with one exemplary embodiment of the present invention includes the steps of: displaying at least one item lottery apparatus for drawing lots for at least one item among the usable items in an online game on one part of an item lottery service screen of a user terminal; displaying an information screen with information regarding the usage of the item lottery service on one part of the item lottery service screen, other than the part where the item lottery apparatus is displayed; sensing usage input of at least one drawing of a lot from the user terminal for any one item lottery apparatus among at least one item lottery apparatus; and displaying, within the information screen, information for at least one item determined to be the winning item, according to the usage input, from among at least one winnable item from any one item lottery apparatus.

20 Claims, 15 Drawing Sheets

METHOD AND APPARATUS FOR MANAGING ITEM LOTTERY SERVICE

CROSS REFERENCE TO RELATED APPLICATION(S)

This application is a 35 U.S.C. §371 National Phase Entry Application from International Application PCT/KR2011/008042, filed on Oct. 26, 2011, the disclosure of which is incorporated herein by reference in its entirety.

TECHNICAL FIELD

The present invention relates to a service for providing items that are usable in an online game or the like through a lottery system. More particularly, the present invention relates to a technique which can increase user utilization of an item shop by providing users with intuitive usage and understanding of a lottery service for high-performance items.

BACKGROUND ART

With the development of communications networks, various online game services have been being provided. Further, as graphics techniques and the performance of user terminals are improved, high-quality game programs are being created. Game contents which provide detailed descriptions for real or visual space have also been being developed.

Accordingly, the user utilization of online games is increased, and the game genres are diversified. Recently, various online games such as sports games, role playing games, and first person shooting games have been most popular.

As one feature of the online games, users can enjoy their favorite online games with each other by simultaneously accessing the same game contents system. The users can individually enjoy the games through cooperation or competition with different users by controlling its character or the like on the same game screen.

Moreover, in the online games, the users can accomplish one mission by cooperation with different users, or can enjoy game contents by competition with different users. In this case, in the online games, it is necessary to provide contents that rouse competitive spirit between the users. This is because it is required to have the users continuously access and play the online games by rousing the competitive spirit between the users in order to maintain or increase the user utilization of the online games in terms of their features.

The contents for rousing the competitive spirit between the users may be roughly divided into a level of a user character, an item that can be applied to the user character, a skill implemented by a user, and the like. Particularly, the level and the skill of the user character may be improved by the user while the user plays the game and increases an experience level of the user character.

Accordingly, a beginner should use items for improving the ability of his/her character to equally compete with skilled users having the higher experience level in the online games. As a result, services such as item design, item image, item sales, and the like have recently become hot issues in the online games.

These items are contents that significantly affect the ability of the user character when users play the online games, and thus may determine game play capabilities. In the online games, the items are designed to be obtained according to game play results, or to be bought by using cyber money.

Particularly, today's spotlights have been focused on an item lottery service that can obtain high-performance items with a predetermined possibility to provide the uses with a new source of fun for the item shop.

DISCLOSURE

Technical Problem

The present invention has been made in an effort to provide a method and an apparatus for managing an item lottery service that can increase an interesting degree of the users in the item lottery service by providing users with intuitive interfaces and enables the users to easily check a lottery target item, thereby improving user utilization of the item lottery service.

Technical Solution

An exemplary embodiment of the present invention provides a method for managing an item lottery service, including: displaying at least one item lottery apparatus for drawing lots for at least one item among usable items in an online game on one part of an item lottery service screen of a user terminal; displaying an information screen with information regarding the usage of the item lottery service on a part of the item lottery service screen, other than a part where the item lottery apparatus is displayed; sensing a usage input of at least one drawing of a lot from the user terminal for any one of the at least one item lottery apparatus; and displaying, within the information screen, information of at least one item determined as being wined, according to the usage input, from among at least one winnable item from any one item lottery apparatus.

Ranking predetermined according to the effect of items may be determined in at least one item that is winnable in each of the at least one item lottery apparatus, and the displaying of the at least one item lottery on the part may include displaying identification information related to an item having the highest ranking among at least one item that is winnable in each item lottery apparatus, on a representative item display screen provided at the each item lottery apparatus, when the item lottery apparatus is displayed.

The displaying of the at least one item lottery on the part includes displaying information related to a remaining available number of the lots at a part of a display region of the at least one item lottery apparatus until the item lottery apparatus is reset for each of the at least one item lottery apparatus.

The sensing of the usage may input include updating number information of lottery items held by a user as a number obtained by deducting a number of the lots for items by the user from a number of the lottery items held by the user.

The sensing of the usage input may include updating number information of the lottery items held by the user as a number obtained by deducting a number of the lots for items by the user from a number obtained by adding a number of free lottery items that are supplied to the user by a predetermined number at every a period, into the number of the lottery items held by the user.

The displaying of the information within the information screen may include displaying information of at least one item determined as being wined per item lottery result corresponding to a number of the lots included in one usage input within the information screen along therewith.

The managing method may further include displaying an item information display menu at a part of a display region of each item lottery apparatus for each of the at least one item lottery apparatus.

The managing method may further include receiving a selection input for the item information display menu from the user terminal; and displaying a pop-up screen with identification information of an item that is winnable in an item lottery apparatus including the item information display menu to which the selection input is applied.

The managing method may further include registering the at least one item determined as being wined in a holding item database of a user.

Another exemplary embodiment of the present invention provides a method for managing an item lottery service, including: receiving a usage input of at least one drawing of a lot for at least one item lottery apparatus for drawing lots for at least one item among usable items in an online game; extracting information related to a number of the lots from the usage input; performing item lottery by as many as the number of the lots; extracting predetermined ranking information according to an item effect per item by analyzing information of at least one kind of item determined as being wined among at least one item that is winnable in the item lottery apparatus as a result of performing the item lottery; and enumeratively displaying the information of the at least one kind of item determined as being wined on a wined item display screen in the order of higher ranking.

The enumeratively displaying may include displaying identification information and ranking information related to an item having the highest ranking among at least one kind of item determined as being wined at a part of the wined item display screen, and the identification related to the item having the highest ranking is different from that of items other than the item having the highest ranking.

The enumeratively displaying may include determining whether there is an item having a predetermined ranking range of the ranking information.

The enumeratively displaying may further includes, when there is the item having the predetermined ranking range, displaying a pop-up screen with winning information of the item having the predetermined ranking range.

The enumeratively displaying may include displaying the information of the at least one item determined as being wined on the wined item display screen at every result of performing the item lottery by as many as the number of lots included in one usage input.

The managing method may further include registering the at least one item determined being wined in a holding item database of a user.

Yet an exemplary embodiment of the present invention provides an apparatus for managing an item lottery service, including: a lottery apparatus display unit configured to display at least one item lottery apparatus for drawing lots for at least one item among usable items in an online game on one part of an item lottery service screen of a user terminal; a lottery input sensor configured to sense a usage input of at least one drawing of a lot from the user terminal for any one of the at least one item lottery apparatus; a wining determiner configured to determine a winning result of at least one item that is winnable in the any one item lottery apparatus by performing item lottery by as many as the number of the lots; a wining information generator configured to generate information of at least one item determined as being wined based on the winning result; and an information screen display unit configured to display the information of the at least one item determined as being wined at a part of the item lottery service screen, other than a part where the item lottery apparatus is displayed.

Ranking information predetermined according to an item effect may be set in at least one item determined as being wined in each of the at least one item lottery apparatus.

The information screen display unit may display the information of the at least one item determined as being wined on the information screen in the order of higher ranking.

The information screen display unit may display identification information and ranking information related to an item having the highest ranking among at least one kind of item determined as being wined at a part of the information screen, and the identification related to the item having the highest ranking may be different from that of items other than the item having the highest ranking.

The information screen display unit, when an item having a predetermined ranking range is determined as being wined, may display a pop-up screen with winning information of the item having the predetermined ranking range.

The lottery apparatus display unit may display, at a part of a region at which each item lottery apparatus is displayed, identification information of an item having the highest ranking among at one item that is winnable in each of the item lottery apparatus.

The lottery input sensor may update number information of lottery items held by a user as a number obtained by deducting a number of the lots for items by the user from a number of the lottery items held by the user.

The lottery input sensor may update number information of the lottery items held by the user as a number obtained by deducting a number of the lots for items by the user from a number obtained by adding a number of free lottery items that are supplied to the user by a predetermined number at every a period, into the number of the lottery items held by the user.

The lottery apparatus display unit may display an item information display menu at a part of a display region of each item lottery apparatus for each of the at least one item lottery apparatus.

The lottery apparatus display unit, when receiving a selection input for the item information display menu from the user terminal, may display a pop-up screen with identification information of an item that is winnable in an item lottery apparatus including the item information display menu to which the selection input is applied.

The managing apparatus may further include an item supply controller configured to register the at least one item determined as being wined in a holding item database of a user.

Advantageous Effects

In accordance with the exemplary embodiments of the present invention, since an item lottery apparatus and an item winning information screen is displayed on one screen, users can repeatedly use the item lottery service. Further, it is possible to intuitively display updating of remaining number of the lots, thereby increasing user utilization of an item lottery service actively.

In addition, since ranking information of items is displayed, it is possible to enable the users to check at which level the wined item has, thereby providing a new source of fun.

MODE FOR INVENTION

Figure 1:
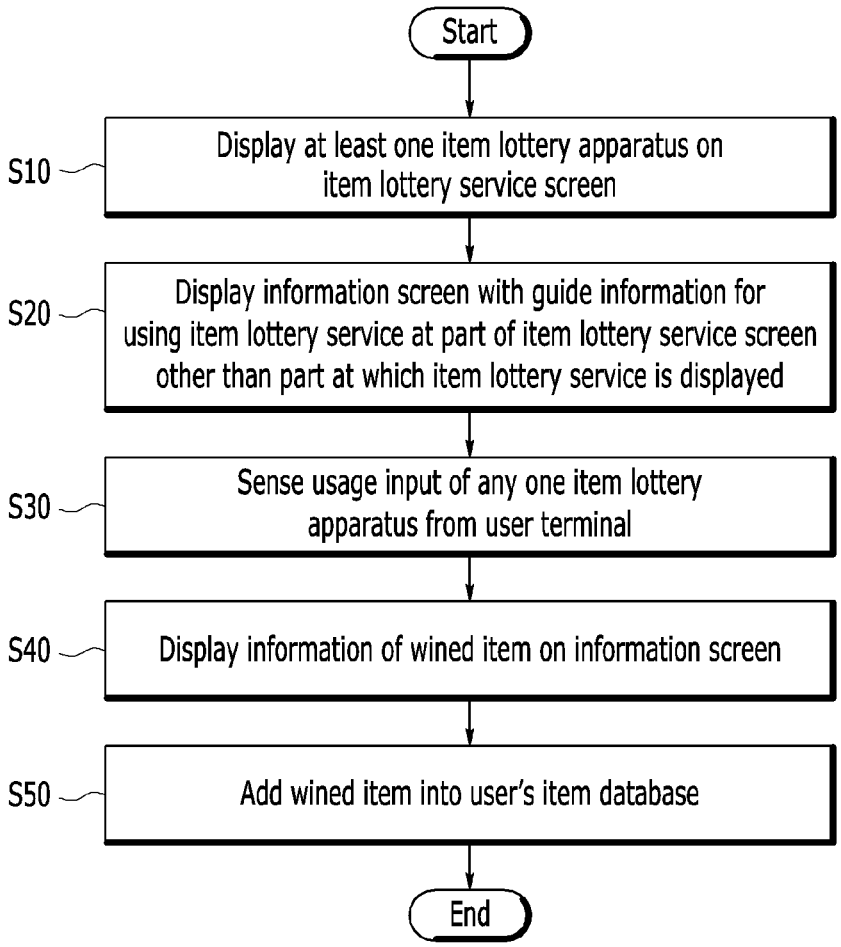
FIG. 1 is a flowchart showing a method for managing an item lottery service in accordance with an exemplary embodiment of the present invention.

Hereinafter, a method and an apparatus for managing an item lottery service in accordance with each exemplary embodiment of the present invention will be described with reference to the accompanying drawings.

It is obvious that the following exemplary embodiment is a detailed description which is provided for more understanding of the present invention but does not limit the scope of the present invention. Therefore, an equivalent invention which performs the same function as the present invention may be also covered by the scope of the present invention.

In adding reference numerals to components of each drawing, even though the same components are illustrated in different drawings, it is to be noted that these components are denoted by the same reference numerals if possible. In describing exemplary embodiments of the present invention, well-known functions or constructions will not be described in detail since they may unnecessarily obscure the understanding of the present invention.

In addition, in describing components of the present specification, terms such as first, second, A, B, (a), and (b) may be used. These terms are used only to differentiate the components from other components, but the nature, sequence, order, etc. of the corresponding components are not limited by these terms. When a component is "connected", "coupled", or "linked" to another component, it is to be noted that the component may be directly connected or linked to the another component, but the component may be "connected", "coupled", or "linked" to the another component via another component therebetween.

In an exemplary embodiment of the present invention, "communication", "communication network" and "network" may be used to have the same meaning. The three terminologies indicate a wired or wireless local area and wide area data transmitting/receiving network through which a file is transmitted/received between a user terminal, another user terminal, and a download server.

In the following description, "game server" indicates a server computer to which users access to use game contents. In the case of a game which has a small capacity or a small number of users, a plurality of game programs may be operated by one game server. Further, in the case of a game which has a large capacity or a large number of real time accessing members, one or more game servers which operate one game may be provided depending on a function of the game.

In addition, middle ware for database or servers which perform payment processing may be connected to the game server, but the description thereof will be omitted in the present invention Herein, an online game indicates game contents that can be used by users who access the aforementioned game server. Particularly, the online game indicates a game that can be simultaneously accessed and enjoyed by a plurality of users and increase levels of the users by, e.g., acquiring experience levels while rearing characters through playing of the game on the game. The online game also indicates a game that can buy various kinds of items on the game to play the game more smoothly.

Herein, an item indicates all data that can give assistance to playing the game and can be generally understood as an item on the game. For example, in a role playing game, an item for further increasing an experience level obtained when a character of a user subdues a monster, an item for changing the appearance of the character, and the like may correspond to the items in the present invention.

In addition, in a sports game, a card item for using a character, an item for increasing a capability level of the character, an item for recovering condition of the character, an item for increasing a capability level on the game and simultaneously for changing the appearance of the character by mounting the card to the character, and the like pertain to the items in the present invention. As such, all items that can be used by a character during the play of a game or can be used by a user to apply it to the game pertain to the items in the present invention.

For the items, the duration of use effect may be permanent or restrictive. In this case, the same kinds of items having different durations are the same items in the present invention. For example, an item "A" for increasing a capability level for one week and an item "A" for increasing a capability level for two weeks may be recognized as the same items although they may be different items from a viewpoint of database.

Hereinafter, an item lottery system, an item lottery system, or the like indicates a system or a service that provides high-grade items having added high effects, e.g., high capability improving levels among items used in the online game by drawing lots in a part of an online game server or an independent server.

The item lottery system includes a medium such as a button, a ticket, a capsule, or the like through a user can manipulate it by using a display unit of a terminal. An operation that can be taken by a user to draw items includes clicking a lottery button through an input unit of a terminal, operating a slot machine displayed on the screen, operating a roulette, using a ticket, drawing a capsule, and the like. In general, any game or algorithm to which a lottery concept can be applied may be used in the item lottery system. However, in the following descriptions, a capsule capable of drawing items is taken as an example for better understanding of the present invention.

FIG. 1 is a flowchart showing a method for managing an item lottery service in accordance with an exemplary embodiment of the present invention.

Referring to FIG. 1, the method for managing an item lottery service in accordance with the present exemplary embodiment includes a step S10 of displaying an item lottery apparatus on an item lottery service screen of a user terminal such that an item lottery system can draw lots for at least one of items that can be used in an online game. In this case, a user can check the item lottery apparatus through the user terminal.

For the item lottery apparatus, at least one item lottery apparatus may be displayed on the service screen according to a group of the drawn items. Further, the item lottery apparatus may be displayed on the screen as an image of a general drawing device or a capsule drawing device. Once a user performs an usage input, a series of animations that shuffle capsules are embodied to output one capsule showing the winning result, Accordingly, when a plurality of item lottery apparatuses are displayed, an image of a plurality of capsule drawing apparatuses may be displayed on a part of the screen. Hereinafter, displaying the item lottery apparatus indicates outputting an image of a capsule drawing apparatus through which a user can use the item lottery service by using a user terminal.

Simultaneously, a step S20 of displaying an information screen with information related to usage of the item lottery service on a part of the item lottery service screen other than the part at which the item lottery apparatus is displayed, by the item lottery system is performed.

The information screen is used to display a method showing how a user uses the item lottery system and event information related to the item lottery system. Further, the information screen is not overlaid on the item lottery apparatus, but is displayed on the item lottery service screen independently of the item lottery apparatus.

Next, a step S30 of sensing the usage input of at least one drawing of a lot from the user terminal for any one item lottery apparatus among at least one item lottery apparatus is performed.

As described above, a plurality of item lottery apparatuses may be simultaneously displayed on the item lottery service screen, and a user may select one of the item lottery apparatuses to perform the usage input. The usage input indicates an input for drawing lots for items by using the item lottery apparatus which is operated by clicking a specific image or a "lottery" button mounted in the item lottery apparatus.

At least one lot is included in the usage input. A user may perform one drawing by one click, but, in the present exemplary embodiment, a plurality of drawings can be performed by one click, i.e., one usage input. This is similar to a concept of buying a plurality of items by one click.

As a result, the item lottery apparatus may display a menu for determining the number of lots to be included in the usage input in addition to a menu for performing the usage input, the number of lots indicating how many drawings are performed by one usage input and is also referred to as "lots number."

For example, when a default lots number is set as 1, but a user wants to perform a plurality of item lotteries by one usage input, the lots number may be determined to, e.g., 5 or 10 to perform the usage input.

Then, the item lottery system perform 5 or 10 item lotteries through one usage input, and winning results are listed and displayed at a lower portion of the user terminal per drawing of each item. Further, the items wined per drawing may be registered in a holding item database.

Next, a step S40 of displaying information of at least one item determined as being wined according to a usage input from among at least one winnable item in any one item lottery apparatus receiving the usage input, within the information screen displayed in the step S20 is performed.

Once the step S40 is performed, the item lottery system performs a step S50 of adding wined items into a user's holding item database. In this way, the user can hold at least one wined item according to the lots number.

In the step S40, information of an item determined as being wined is displayed within the information screen which has continuously been being displayed instead of being displayed on a pop-up screen to be overlaid on the item lottery apparatus.

In this case, for the information of the item determined as being wined which is displayed within the information screen, information of at least one item determined as being wined per item lottery result corresponding to the lots number included in one usage input may be displayed together on one information screen. As a result, as described above, a plurality of lots numbers may be included in one usage input, and as many winning results as the lots numbers may be outputted in the item lottery apparatus.

Once as many winning results as the lots numbers are outputted, there is at least one item determined as being wined by a user at each winning result, and thus the item(s) determined as being wined can be displayed all together on the information screen. As a result, the items determined as being wined when displayed on the information screen are grouped in a unit of input.

Accordingly, users can check a state of the item lottery apparatus, i.e., remaining available number of lots for items until the item lottery apparatus is reset, and thus can immediately perform the item lottery again. As a result, it is possible to increase an interesting level in the item lottery service of users by allowing the users to intuitively check item lottery service contents on one screen In other words, when the item lottery service is used, the information screen usually displays usage guide and event information. However, when a user starts the usage input for the item lottery service by using the item lottery service, the information screen displays the winning result.

Figure 2:
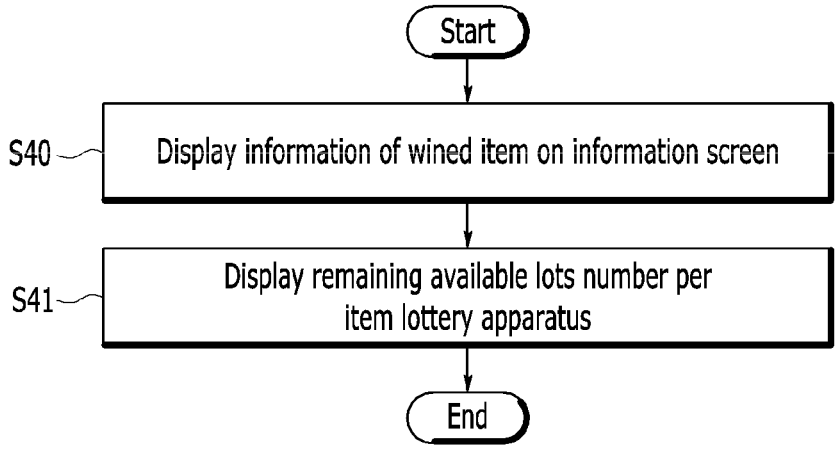
FIG. 2 shows a flow after the item lottery service is used in accordance with the present exemplary embodiment.

FIG. 2 shows a flow after the item lottery service is used in accordance with the present exemplary embodiment. In the following description, a repeated description with the description of FIG. 1 will be omitted.

In accordance with the present exemplary embodiment, in the item lottery apparatus, an available lots number is determined. The available lots number of the item lottery apparatus indicates the number of lots that can be drawn, e.g., 500 at the maximum, in which high grade items are winnable.

Accordingly, users checks whether an item is wined by consuming the available lots numbers. As a result, if the usage input of the item lottery apparatus is sensed from the user terminal (S30), the system displays information of the wined item on the information screen based on the winning result (S40) on the information screen.

In the item lottery apparatus, each representative high grade item may be advertised as the wined item, and other items may also be wined. This is similar to a concept of wining the second to fifth prizes in addition to the first prize in a lottery ticket. As a result, each item lottery apparatus has a representative drawable item, and at least one item as a winnable item in addition to the representative item.

In the present exemplary embodiment, when the representative item is wined, the item lottery apparatus is reset to an initial number of lots (e.g., 1000). As users use this item lottery apparatus, the available lots number is reduced by the number of lots that were drawn until the representative is wined again.

Accordingly, after the step S40, the system may a step S41 of displaying information of remaining available lots number per item lottery apparatus at a part of the display region of each item lottery apparatus until at least one item lottery apparatus is reset, i.e., the representative item is wined.

As a result, users can check their wined items through the information screen and immediately check the remaining lots number. As the remaining lots number is reduced, the users expect higher possibility that the representative item is wined and, accordingly, can immediately restart the usage input.

Figure 3:
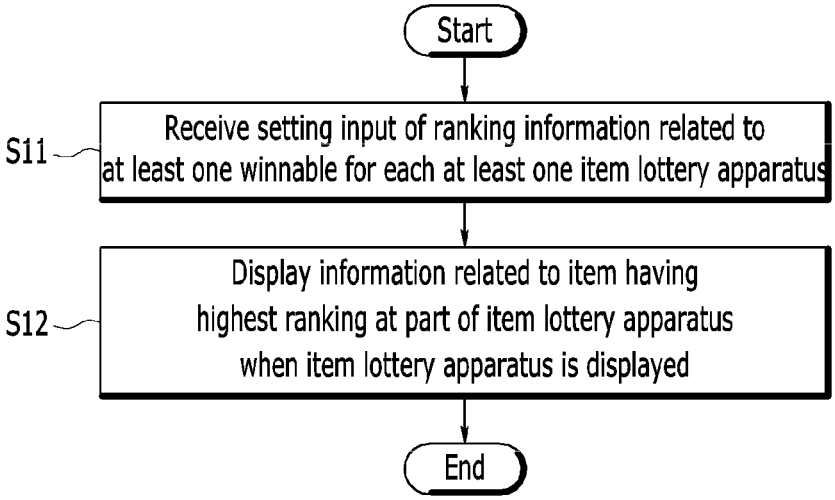
FIG. 3 shows a method for additionally displaying information on an item lottery apparatus in accordance with the present exemplary embodiment.

FIG. 3 shows a method for additionally displaying information on an item lottery apparatus in accordance with the present exemplary embodiment. In the following description, a repeated description with the description of FIGS. 1 and 2 will be omitted.

Referring to FIG. 3, in the present exemplary embodiment, ranking is determined per item. Specifically, in the item lottery apparatus, each winnable item has ranking information per item lottery apparatus. For example, when one item lottery apparatus has 10 winnable items, the ranking of each item ranges from 1 to 10. The same items may have different ranking information according to item lottery apparatuses pertaining thereto.

The ranking information of items is predetermined according to the effect of each item. For example, a user terminal may set the ranking information of items per item lottery apparatus by comparing the effects of the items and positioning the ranking information of an item determined as having a higher scarcity value at a higher level.

Alternatively, the ranking is automatically determined according to the prices of the items. Since the winnable item in the item lottery apparatus may be an item that can be sold in an item shop, the ranking may be determined according to the prices of the items that are sellable in the item shop.

The representative item described in FIG. 2 may indicate an item determined to have the highest ranking (e.g., first ranking) for each item lottery apparatus.

Since the ranking is determined for each item, the system performs a step S11 of receiving a setting input of ranking information related to at least one winnable item for each at least one item lottery apparatus from, e.g., a manager terminal when setting the item lottery apparatus. Accordingly, each item lottery apparatus has ranking information predetermined according to an effect of each item.

Then, the system may perform a step S12 of displaying identification information related to the item having the highest ranking (first ranking) among at least one item that is winnable in each item lottery apparatus, on a representative item display screen provided in each item lottery apparatus when the item lottery apparatus is displayed on the item lottery service screen.

As a result, when the item lottery apparatus is checked by users through the screen, it is possible to improve users' desires to use the item lottery apparatus by allowing the users to check which item is the highest grade item that is winnable per item lottery apparatus.

The identification information of the item that is displayed on the representative display screen of the item lottery apparatus may include ranking information thereof, image information for identifying items, text information thereof, and the like.

Figure 4:
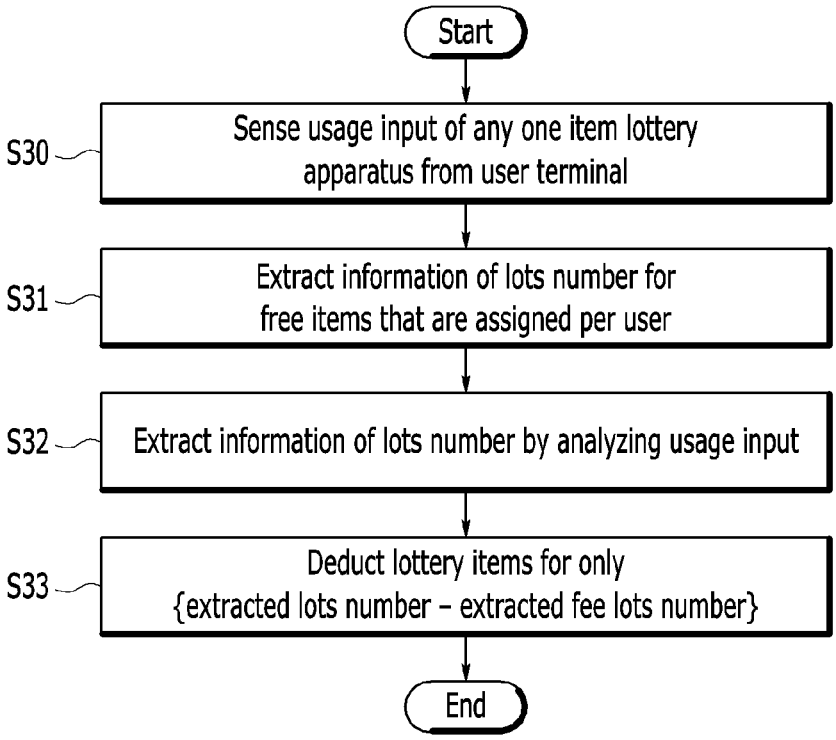
FIG. 4 shows a flow for calculating and displaying the number of lottery items in accordance with the present exemplary embodiment.

FIG. 4 shows a flow for calculating and displaying the number of lottery items in accordance with the present exemplary embodiment. In the following description, a repeated description with the description of FIGS. 1 to 3 will be omitted.

First, the system senses the usage input of any one item lottery apparatus from a user terminal S30.

In the present exemplary embodiment, a lottery item or a cyber money for using the item lottery apparatus is consumed in order to use the item lottery service. In other words, a lottery coin or the like may be bought in the item shop. By using one lottery coin, the usage input having one lot is performed. In the case of using a plurality of lottery coins at once, a usage input having lots numbers corresponding to the number of the lottery coins may be performed.

Alternatively, when 5,000 cyber moneys are required for one lot (herein, the cyber money is a point that can be acquired according to the play of a game), the cyber moneys of 5000× the lots number is deducted from the cyber moneys held by a user, thereby performing the usage input having the lots number.

As a result, once the usage input is sensed through the step S30, the lottery item or the cyber money is required to be deducted. In the following descriptions, the lottery item is representatively explained. However, it is obvious to understand the cyber money as one of item contents, and thus the lottery item should be construed as including the meaning of the cyber money.

In other words, once the step S30 of sensing the usage input, the system first analyzes the usage input to extract information of the aforementioned at least one lot included in the usage input (S32).

In the meantime, in accordance with the present exemplary embodiment, a free opportunity for drawing lots may be given to users at every predetermined period (e.g., 24 hours). This is to increase an access rate of users to an item lottery service screen. For example, users can receive one free lottery item every day, and the free lottery item may be used for the item lottery service.

Accordingly, before the step S32, the system may extract information related to lots number for free items that are assigned per user when the usage input is received (S31).

Then, a step S33 of obtaining a first number by adding an extracted number of free lottery items that are supplied by a predetermined number when the lottery item is deducted according to the usage of the item lottery service, into the number of lottery items that are held by a user, and updating number information of the lottery items held by the user as a second number obtained by deducting the number corresponding to the extracted lots number from the first number.

For example, when the free lottery item supplied to the user is one drawable item, the user holds 15 lottery items, and the user sets 5 lots numbers in one usage input, the number of the updated lottery items held by the user will bell.

If the user has no free item, it is obvious to update the number information of the lottery items held by the user as a third number obtained by deducting the number corresponding to the lots number from the number of the lottery items held by the user.

Figure 5:
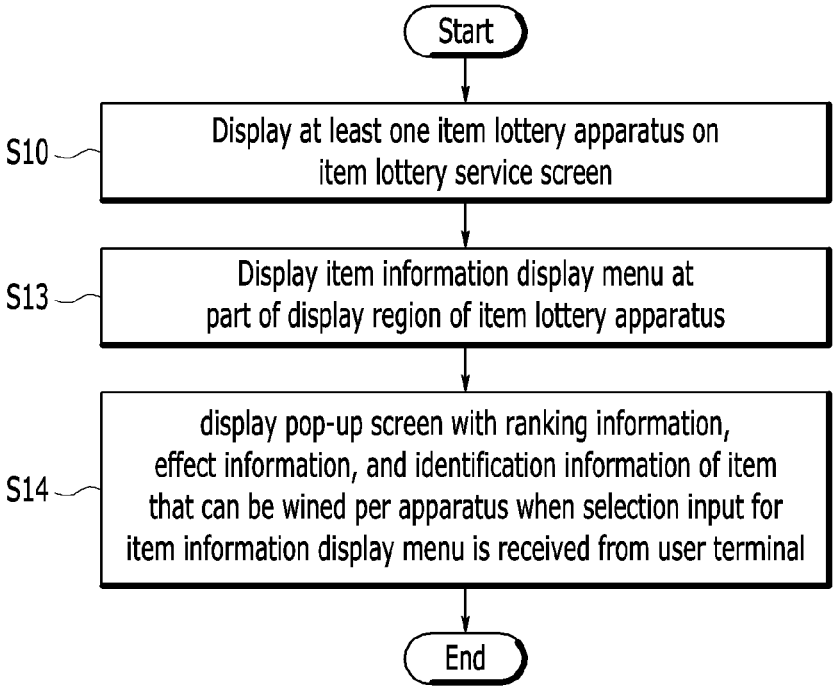
FIG. 5 shows a flow for displaying information of a winnable item in accordance with the present exemplary embodiment.

FIG. 5 shows a flow for displaying information of a winnable item in accordance with the present exemplary embodiment.

In the present exemplary embodiment, winnable items may be included for each at least one item lottery apparatus, and a screen for check the winnable items may be provided.

Accordingly, the system may display an item information display menu at a part of the region at which the item lottery apparatus is displayed per item lottery apparatus (S13).

In this case, once a selection input for an item information display menu is received from a user terminal, the system may control a pop-up screen to enumeratively display identification information of the winnable items per item lottery apparatus S14.

In this case, as described above, the system may analyze the ranking information determined per item to enumeratively display the items in the order of higher ranking.

As a result, it is possible to improve user utilization of the item lottery service by allowing the users to check the items that can be acquired through their lotterys as described above.

Figure 6:
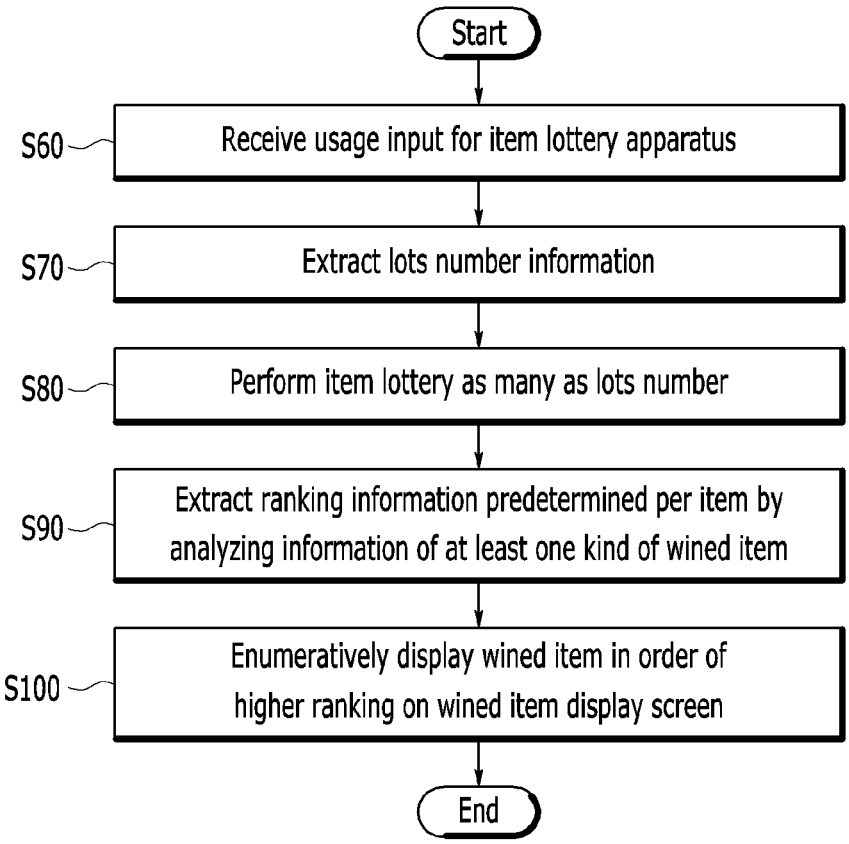
FIG. 6 is a flowchart showing a method for managing an item lottery service in accordance with another exemplary embodiment of the present invention.

FIG. 6 is a flowchart showing a method for managing an item lottery service in accordance with another exemplary embodiment of the present invention. In the following description, a repeated description with the description of FIGS. 1 to 5 will be omitted.

Referring to FIG. 6, the method for managing an item lottery service in accordance with the present exemplary embodiment includes a step S60 of receiving the usage input of at least one drawing of a lot for the item lottery apparatus.

Next, the system extracts information related to the lots number included in the usage input (S70), and performs the item lottery by as many as the lots number (S80).

When each item is drawn, whether any one of at least one item that can be wined in the item lottery apparatus is wined in a specific possibility is determined. Accordingly, the system performs a step S90 of extracting ranking information predetermined in each item by collecting and analyzing information of at least one kind of item determined as being wined for each item lottery corresponding to the lots number among at least one item can be wined in the item lottery apparatus as a result of item lottery. The ranking information is the same as described above, and thus the description thereof will be omitted.

Once the step S90 is performed, the system enumeratively displays the information of at least one kind of item determined as being wined on a screen on which the wined item is displayed (e.g., the information screen of FIG. 1) in the order of higher ranking (S100).

The display of the information of at least one kind of item in the step S100 may be understood as the display of information of each kind of items since items determined as being wined based on the winning result for each item are the same. Alternatively, when the same items are wined, a plurality of wining information may be displayed.

The information of items to be displayed may be used as identification information for identifying wined items by including text and/or image contents, and may also include the ranking information predetermined per item. Accordingly, a user can recognize whether an item drawn by the user is good or less valuable by checking the grade of the item drawn by the user, and thus the desire to a next lottery can be improved.

As described with reference to FIG. 1 to FIG. 5, for the information of items determined as being wined which is displayed at once in the exemplary embodiments, the information of items determined as being wined may be displayed all together per item lottery execution result corresponding to the lots number included in one usage input.

Further, the items determined as being wined may be registered in a holding item database of the user by the system.

Figure 7:
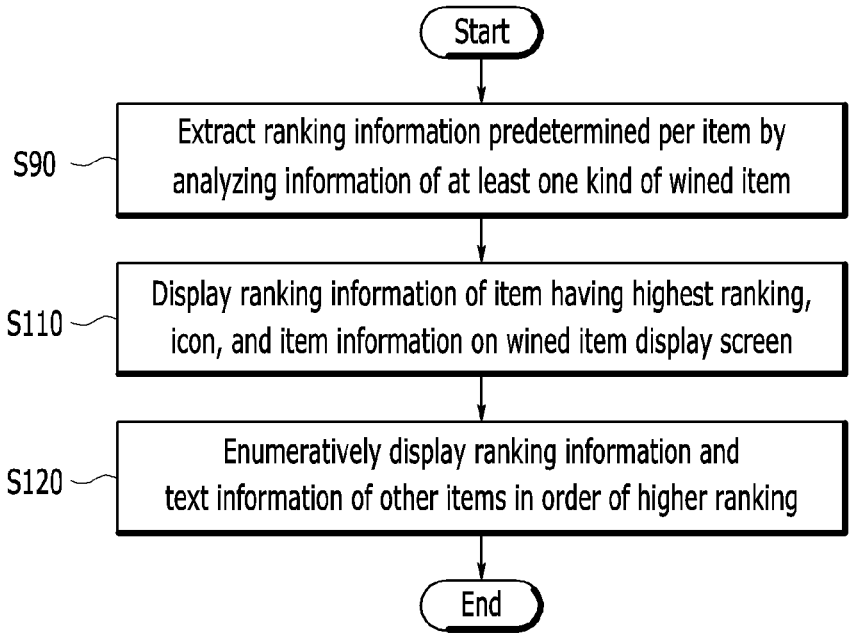
FIG. 7 is an example of a flow for displaying a wined item in accordance with the present exemplary embodiment.

FIG. 7 is an example of a flow for displaying a wined item in accordance with the present exemplary embodiment.

Referring to FIG. 7, the step S90 of extracting ranking information of each item by analyzing at least one kind of item determined as being wined is first performed.

Next, a step S110 of selecting an item having the highest ranking among the at least one kind of item determined as being wined when the item is displayed, and displaying ranking information of the selected item, an image thereof such as an icon, and identification information as item information is performed. Then, a step S120 of enumeratively displaying the item information including text information and ranking information of the remaining items in the order of higher ranking is performed.

As a result, in FIG. 7, the identification information and the ranking information of the item having the highest ranking are displayed, and the identification information of the item having the highest ranking may serve as identification information that is distinguished from identification information to be displayed for the items other than the item having the highest ranking.

For example, for the item having the highest ranking among the items determined as being wined, a display region is assigned to display image information such as an icon for identifying the item, the ranking information thereof, and text information for explaining the item. However, for the remaining items, only ranking information and text information thereof are enumeratively displayed. Accordingly, it is possible to separately check the item having the highest ranking.

Figure 8:
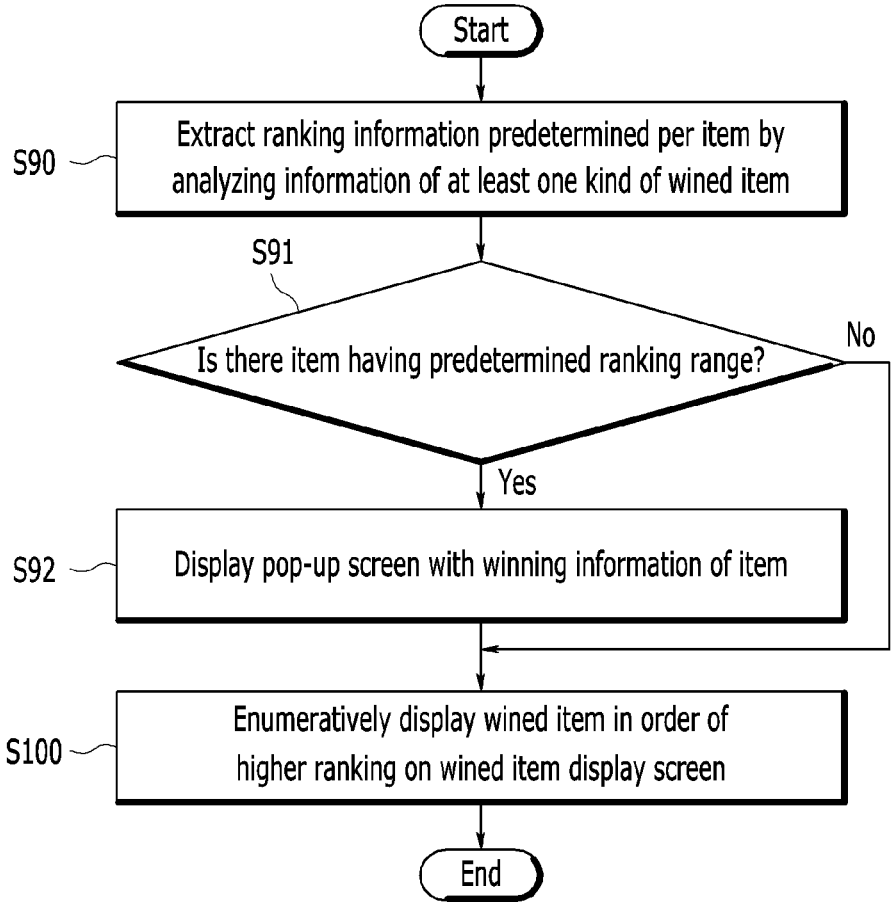
FIG. 8 is another example of a flow for displaying a wined item in accordance with the present exemplary embodiment.

FIG. 8 is another example of a flow for displaying a wined item in accordance with the present exemplary embodiment.

Referring to FIG. 8, the step S90 of extracting ranking information of each item by analyzing at least one kind of item predetermined as being wined is first performed.

In the exemplary embodiments, as described with reference to FIG. 1 to FIG. 5, a representative item that can be wined is provided per item lottery apparatus. The representative item indicates an item having the highest ranking among the items that can be wined per item lottery apparatus.

In an example of FIG. 8, the system may perform a step S91 of determining whether there is an item having a predetermined ranking range (e.g., first ranking) among at least one kind of item determined as being wined by analyzing extracted ranking information of items.

If there is the item having the predetermined range, a step S92 of displaying winning information of the item having the predetermined range through a pop-up screen is performed. As a result, when the representative item or the like is wined, it is possible to improve a fun of the item lottery service by overlaying the pop-up screen for providing the users with fun or re-informing the representative item is wined, on the service screen to be displayed.

Next, a step S100 of displaying information of the wined items in the order of higher ranking by analyzing ranking information of the wined items is performed.

Figure 9:
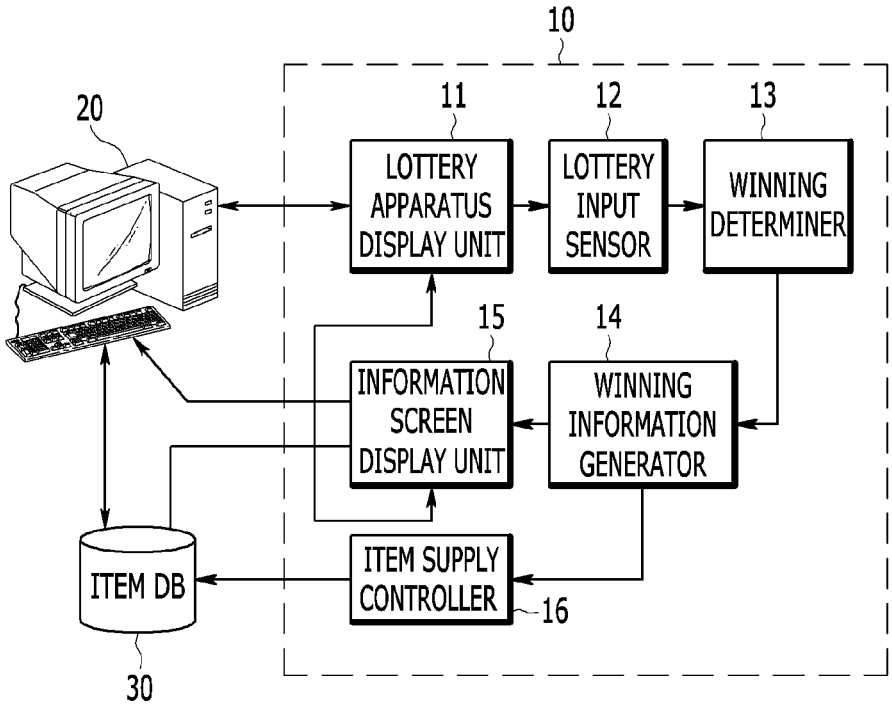
FIG. 9 is a block diagram showing an apparatus for managing an item lottery service in accordance with an exemplary embodiment of the present invention.

FIG. 9 is a block diagram showing an apparatus for managing an item lottery service in accordance with an exemplary embodiment of the present invention. In the following description, a repeated description with the description of FIGS. 1 to 8 will be omitted.

Referring to FIG. 9, the apparatus 10 for managing an item lottery service in accordance with the present exemplary embodiment includes a lottery apparatus display unit 11, a lottery input sensor 12, a wining determiner 13, a wining information generator 14, an information screen display unit 15, and a an item supply controller 16.

The lottery apparatus display unit 11 serves to perform a function of displaying an item lottery apparatus on an item lottery service screen of a user terminal or to control the item lottery apparatus to be displayed on a part of the item lottery service screen.

In this case, identification information related to an item determined to have the highest ranking among at least one item that can be wined in each item lottery apparatus may displayed within a part of a display region of each item lottery apparatus, i.e., the aforementioned representative item display region.

Further, an item information display menu may be displayed at a part of the region at which the item lottery apparatus is displayed. When a selection input for a region at which an item information display menu is displayed is received from a user terminal, it is possible to control a pop-up screen including identification information of an item that can be wined in the item lottery apparatus including the item information display menu to which the selection input is applied. In this case, the items are enumeratively displayed in the order of higher ranking on the pop-up screen.

The lottery input sensor 12 serves to perform a function of sensing a usage input including at least one lot of a user terminal for any one of each item lottery apparatus In this case, the lottery input sensor 12 updates the number of lottery items held by a user by deducting the number corresponding to the lots number included in the usage input from the number of the lottery items held by the user Further, in the case that the user holds free lottery items, the number of the lottery items held by the user is updated by deducting the number corresponding to the lots number included in the usage input from the number obtained by adding the number of the free lottery items into the number of the lottery items.

The wining determiner 13 serves to perform the item lottery by as many as the lots number included in the usage input and determine whether at least one item for the item lottery apparatus is wined as a result of the execution.

The wining information generator 14 serves to generate information of the item determined as being wined based on the winning result and transmit it to the information screen display unit 15 and the item supply controller 16.

The information screen display unit 15 serves to display the information of the item generated by the wining information generator 14 at a part of the item lottery service screen except an area at which the item lottery apparatus is displayed. In other words, the information screen display unit 15 displays information of the items determined as being wined.

The information screen display unit 15 may display identification information and ranking information of an item having the highest ranking among information of the items determined as being wined, and display identification information that is distinguished from identification information to be displayed for the items other than the item having the highest ranking Further, in the case that an item having a predetermined ranking range (e.g., the highest one of the ranking information determined in the item lottery apparatus) is determined as being wined, it is possible to display the winning result of the item having the predetermined ranking information through a pop-up screen to inform the winning result.

The item supply controller 16 serves to control at least one item determined as being wined to be registered in a holding item database of the user, included in an item database 30 provided within the game.

Figure 10:
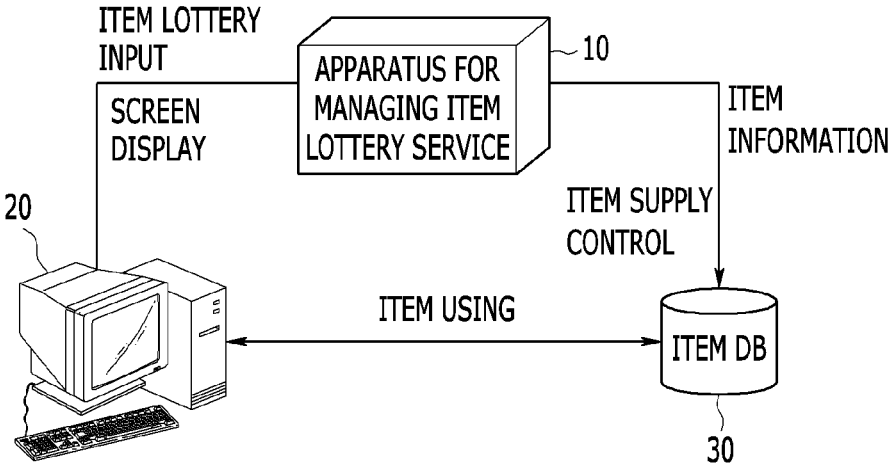
FIG. 10 is a schematic diagram showing a system including the apparatus for managing the item lottery service in accordance with the present exemplary embodiment.

FIG. 10 is a schematic diagram showing a system including the apparatus for managing the item lottery service in accordance with the present exemplary embodiment. In the following description, a repeated description with the description of FIGS. 1 to 9 will be omitted.

Referring to FIG. 10, a user terminal 20 may transmit a usage input such as an item lottery input to the apparatus 10 for managing an item lottery service, and the apparatus 10 may control the user terminal 20 to display the aforementioned components included in the item lottery service screen.

A control command for supplying an item to the user terminal 20 may be transferred from the apparatus 10 to the item database 30, and item information (e.g., ranking information and identification information including image and text) may be transferred from the item database 30 to the apparatus 10.

When a game is actually played, the update of the item database 30 may be performed in real time by an input of the user terminal 20 as an item is used, for example.

FIG. 11 to FIG. 15 show examples of an item lottery service screen displayed on a user terminal in accordance with the present exemplary embodiment. In the following description, a repeated description with the description of FIGS. 1 to 10 will be omitted.

Figure 11:
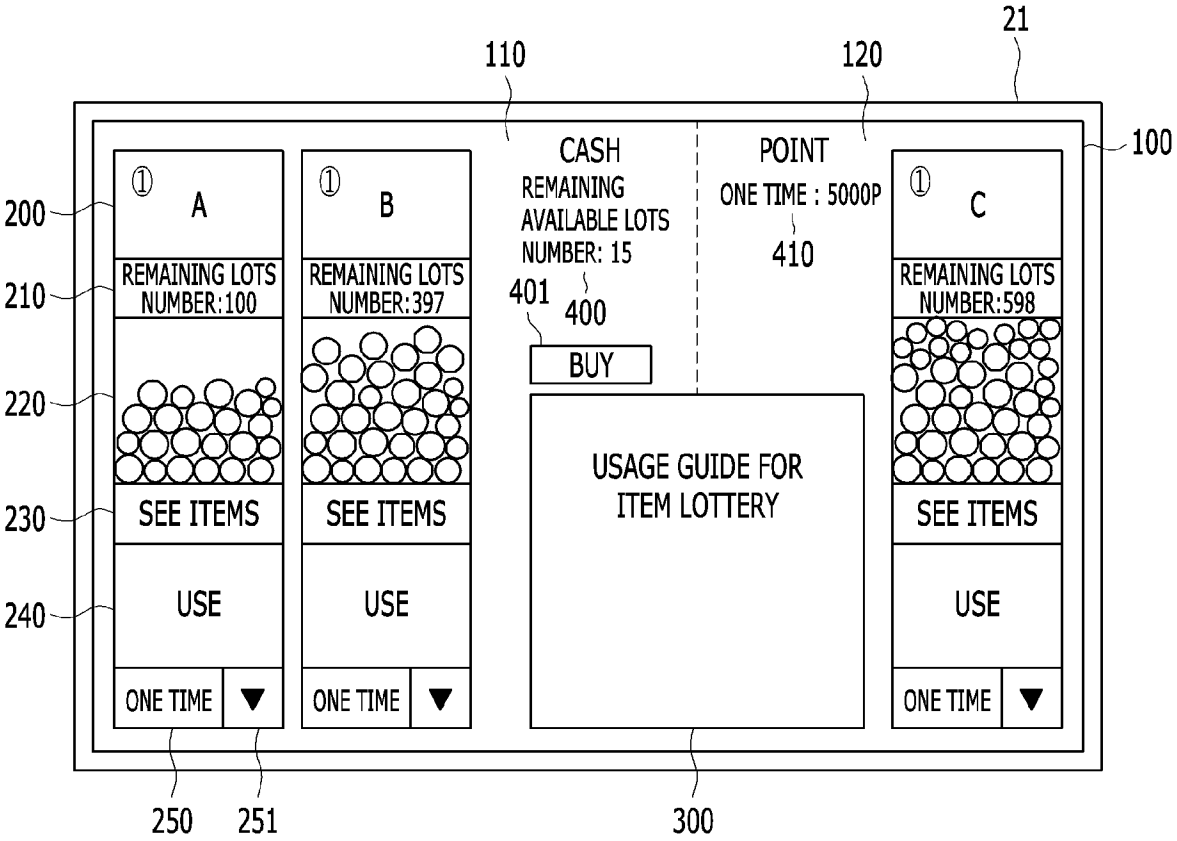
FIG. 11 to FIG. 15 show examples of an item lottery service screen displayed on a user terminal in accordance with the present exemplary embodiment.

Referring to FIG. 11, an item lottery service screen 100 is first displayed on a display unit 21 of a user terminal.

The item lottery service screen 100 separately includes a cash item lottery screen 110 for buying a lottery item by using real cash per item consumed for using the item lottery, and a point item lottery screen 120 for performing the item lottery by using points that can be acquired in the game.

The cash item lottery screen 110 displays a holding item number screen 400 for displaying the number of the lottery items held by the user as "remaining available lots numbers: 00 (e.g., 15)," and the point item lottery screen 120 displays a point information screen 410 for displaying how many points are consumed by a user for one lot.

A plurality of item lottery apparatuses is displayed on the item lottery service screen 100. Each item lottery apparatus includes a representative item display region 200 for displaying an item having the highest ranking among the items that can be wined in the item lottery apparatus, a remaining lots number information region 210 for displaying a remaining frequency of the lottery that can be performed at the maximum until each item lottery apparatus is reset, an animation screen 220 that is embodied according to an operation of the item lottery apparatus, and an item information display menu 230 as "see items."

A "use" menu serves to perform a usage input. A user may determine the lots number to be included in one usage input by manipulating lots number determining menus 250 and 251 and perform the usage input for the item lottery apparatus by clicking the use menu 240.

A "buy" menu 401 serves to display a screen for buying a lottery item to start the usage input for the item lottery apparatus, and information related to a usage guide for the item lottery service screen 100 may be displayed through an information screen 300.

Figure 12:
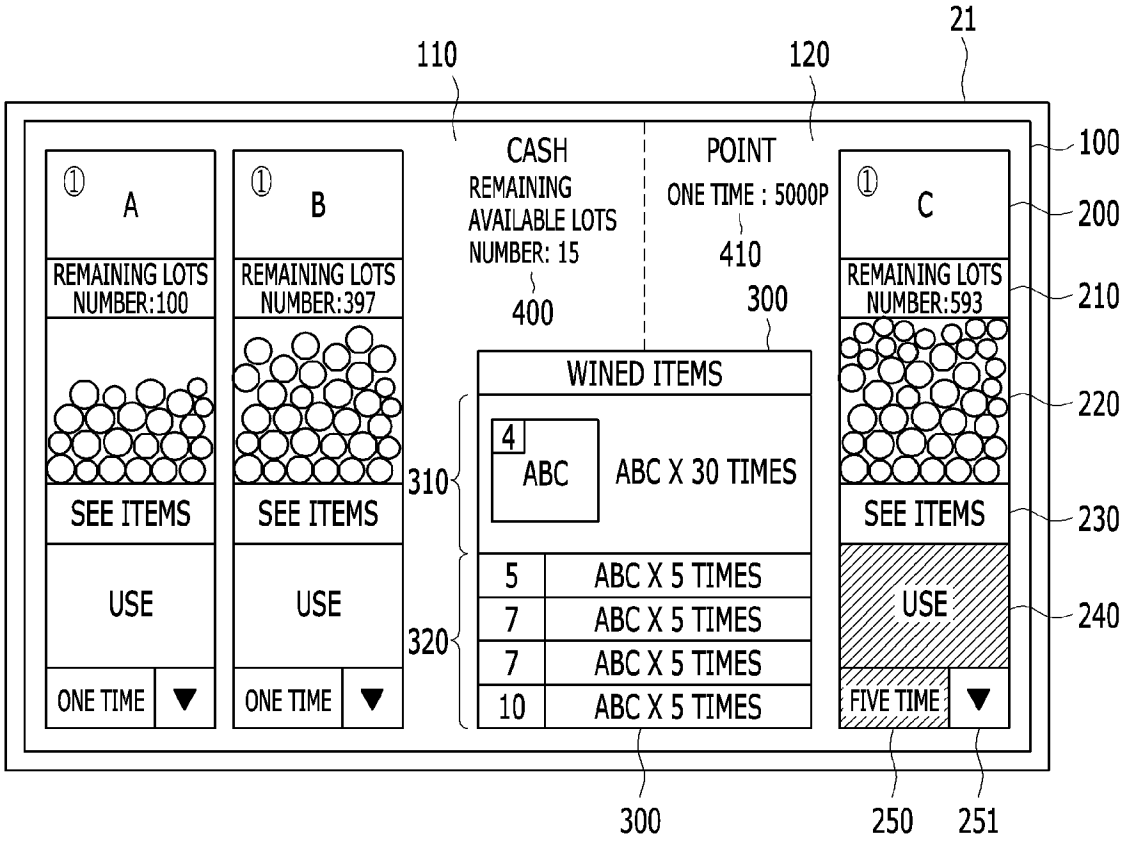

FIG. 12 shows the information screen 300 when the usage input having, e.g., 5 lots numbers. The reference numerals of FIG. 12 are the same as those of FIG. 11, and thus the descriptions thereof will be omitted.

On the information screen 300, information of the items that are wined according to a user attempt to the item lottery is displayed. Ranking information is included in the information of each item, and the ranking information is enumeratively displayed in the order of higher ranking.

In this case, an 'ABC' item having the highest ranking among the wined items having the ranking of 4 may be checked through a screen 310 that displays identification information including image contents and text contents.

In this case, other wined items may be checked though a screen 320 that displays only text information in addition to the ranking information. As a result, the identification information of the item having the highest ranking among the wined items serves as identification information that is different from the identification information of the items other than the item having the highest ranking.

Figure 13:
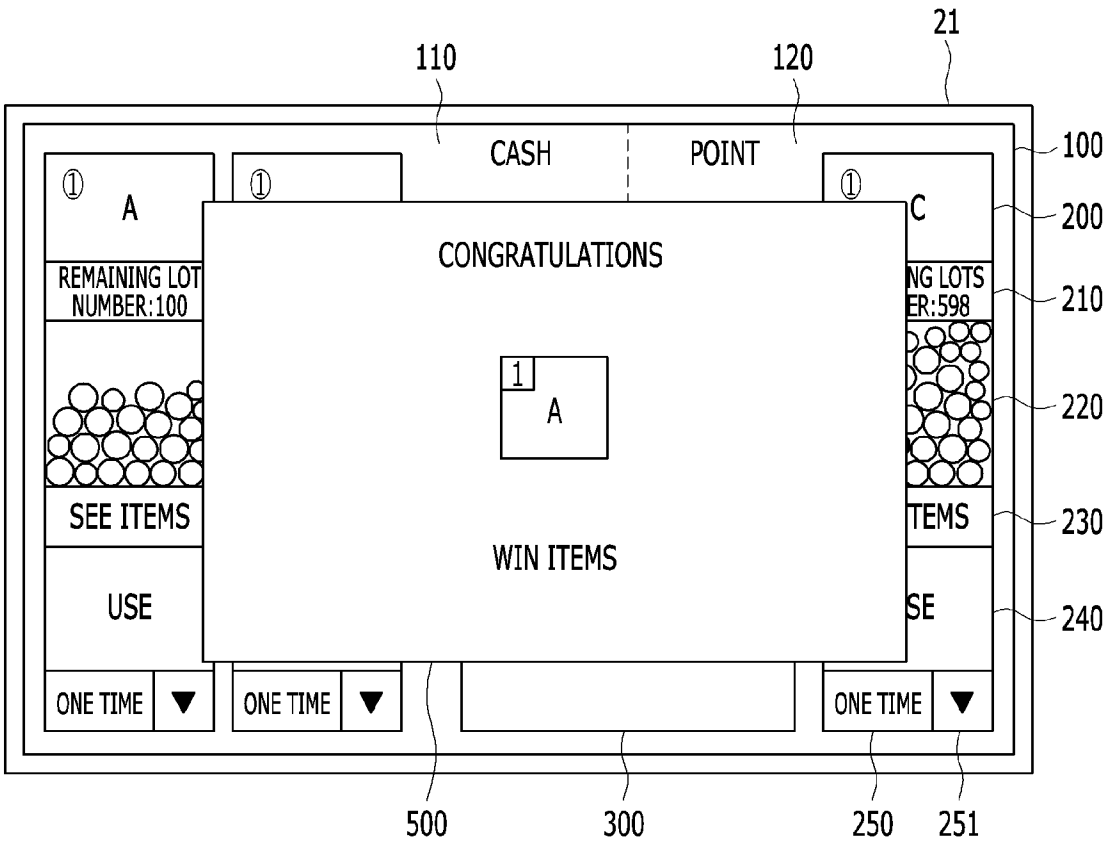

FIG. 13 shows a wining report screen 500 displayed when an item having the highest ranking among the wined items, i.e., an item having a predetermined ranking range in the descriptions made with reference to FIGS. 1 to 10 is wined. Similarly, the reference numerals of FIG. 13 are the same as those of FIG. 11, and thus the descriptions thereof will be omitted.

The wining report screen 500 is a pop-up screen that is overlaid on a main screen unlike information screen for displaying a wined item. This may make users feel extreme happiness when the users win the representative item.

Figure 14:
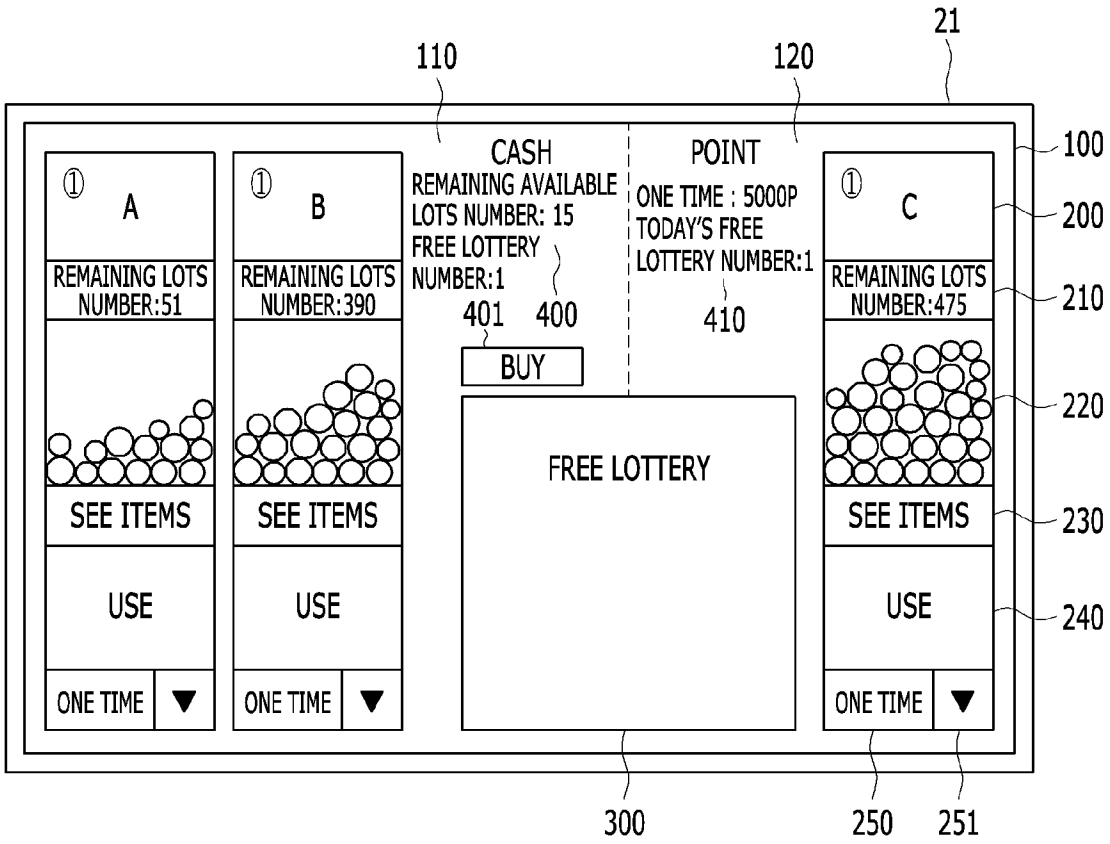

Referring to FIG. 14, the holding item number screen 400 is displayed within the cash item lottery screen 110, and point information screen 410 for displaying how many points are consumed by a user for one lot is displayed within the point item lottery screen 120.

In FIG. 14, information of a free lottery item that is supplied to the users at every predetermined period (e.g., 24 hours) is displayed on each of the screens 400 and 410. In the screen of FIG. 4, the information of the free lottery item is displayed on each of the cash item lottery screen 110 and the point item lottery screen 120.

In this case, a user can perform one free lottery for any one of the item lottery apparatuses pertaining to the cash item lottery screen 110 and can also perform one free lottery for any one of the item lottery apparatuses pertaining to the point item lottery screen 120.

Similarly, the reference numerals of FIG. 14 are the same as those of FIG. 11, and thus the descriptions thereof will be omitted.

Figure 15:
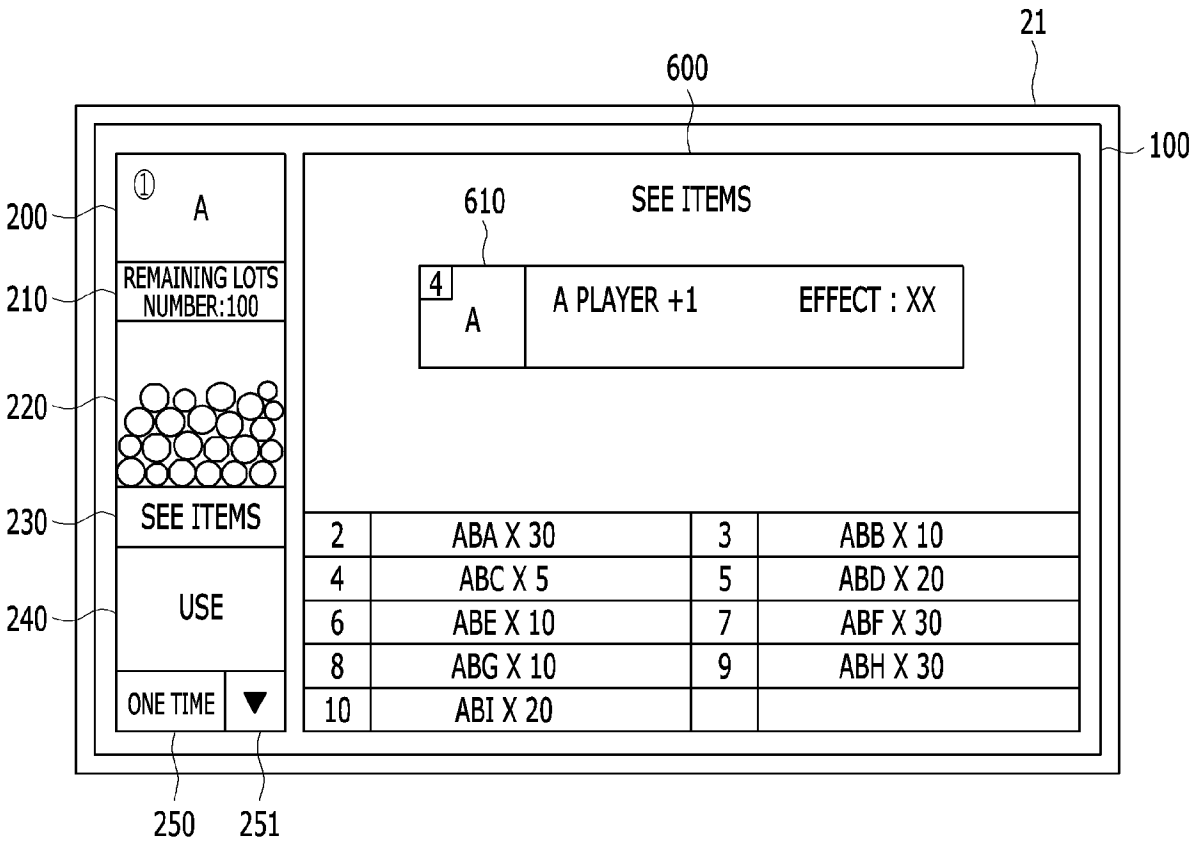

Referring to FIG. 15, when the item information display menu 230 is selected, corresponding item information is displayed though a pop-up screen 600.

On the pop-up screen 600, the items that can be wined through the item lottery apparatus to which the item information display menu 230 pertains are enumeratively displayed in the order of higher ranking. Particularly, an item having the highest ranking (e.g., first ranking) is displayed in detail on an additional screen 610. For example, an image, a name, an effect of the item and the like are displayed.

For other items, a ranking information screen 620 and an item text identification information screen 630 are displayed, so that the users can check which item is wined when the item lottery is performed through this item lottery apparatus.

Similarly, the reference numerals of FIG. 15 are the same as those of FIG. 11 to FIG. 14, and thus the descriptions thereof will be omitted.

The method for managing an item lottery service in accordance with the exemplary embodiments of the present invention as described above may be executed by the applications basically installed in the terminal (including programs included in a platform, an operating system, or the like which are basically installed in the terminal), and may also be executed by the applications (i.e., programs) which are directly installed in the terminal by the user via an application store server or an application store server such as a web server associated with the applications or the corresponding services. In this respect, the method for managing an item lottery service in accordance with the exemplary embodiments of the present invention may be implemented by the applications (i.e., programs) which are basically installed or directly installed by the user in the terminal and may be recorded in a computer readable recording medium of the terminal, and the like The programs are recorded in the computer readable recording medium and are executed by the computer, such that the above-mentioned functions may be executed.

As described above, in order for the computer to read the programs recorded in the recording medium and execute the method for managing an item lottery service in accordance with the exemplary embodiments of the present invention, the above-mentioned programs may include codes which are coded with computer languages such as C, C++, JAVA, machine language, and the like which may be read by a processor (CPU) of the computer.

The code may include a function code associated with a function of defining the above-mentioned functions and may also include an execution procedure related control code required for the processor of the computer to execute the above-mentioned functions according to a predetermined procedure.

Further, the code may further include a memory reference related code indicating at which location (address number) of the memory inside or outside the computer additional information or media required for the processor of the computer to execute the above-mentioned functions need to be referenced.

Further, in order for the processor of the computer to execute the above-mentioned functions, when the processor needs to communicate with any other computers or servers, etc. at a remote location, the code may further include a communication related code about how the processor of the computer communicates with any other computers or servers at a remote location or which information or media the processor of the computer transmits and receives at the time of the communication, by using the communication module (for example, wired and/or wireless communication module) of the computer.

Further, a functional program for implementing the present invention, a code and a code segment associated therewith, and the like may be easily inferred or changed by programmers in the art to which the present invention pertains in consideration of a system environment of the computer which reads the recording medium and executes the program.

Hereinabove, examples of a computer readable recording medium recorded with programs as described above include a ROM, a RAM, a CD-ROM, a magnetic tape, a floppy disk, an optical media storage device, and the like.

Further, a computer readable recording medium recorded with programs as described above may be distributed to a computer system connected through a network and thus store and execute a computer readable code by a distributed manner. In this case, at least one computer among a plurality of distributed computers may execute a part of the above-mentioned functions and transmit the executed results to at least one of the other distributed computers, and the computer receiving the result may also execute a part of the above-mentioned functions and provide the executed results to the other distributed computers.

In particular, a computer readable recording medium recorded with applications, which are programs for executing the method for managing an item lottery service in accordance with the exemplary embodiments of the present invention, may be a storage medium (for example, hard disk, and the like) included in an application store server or an application providing server such as a web server associated with applications or corresponding services, and the like, or the application providing server itself.

A computer, which may read a recording medium recorded with applications that are programs for executing the method for managing an item lottery service in accordance with the exemplary embodiments of the present invention, may include not only a general PC such as a typical desktop and a laptop but also a mobile terminal such as a smart phone, a tablet PC, personal digital assistants (PDAs), and a mobile communication terminal, and is to be construed as all the computable devices.

When a computer, which may read a recording medium recorded with applications that are programs for executing the method for managing an item lottery service in accordance with the exemplary embodiments of the present invention, is a mobile terminal such as a smart phone, a tablet PC, a personal digital assistant (PDA), and a mobile communication terminal, the applications are downloaded from an application providing server to a general PC and thus may also be installed in the mobile terminal through a synchronization program.

Hereinabove, although it has been mentioned that all components configuring the exemplary embodiment of the present invention described hereinabove are combined with each other as one component or are combined and operated with each other as one component, the present invention is not necessarily limited to the above-mentioned exemplary embodiment. That is, all the components may also be selectively combined and operated with each other as one or more component without departing from the scope of the present invention. In addition, although each of all the components may be implemented by one independent hardware, some or all of the respective components which are selectively combined with each other may be implemented by a computer program having a program module performing some or all of functions combined with each other in one or plural hardware. The codes and the code segments configuring the computer program may be easily inferred by a person having ordinary skill in the art to which the present invention pertains. The computer programs are stored in the computer readable media and are read and executed by the computer and may implement the exemplary embodiment of the present invention. As the storage medium of the computer programs, a magnetic recording medium, an optical recording medium, and the like may be used.

Further, it will be further understood that the terms "comprises" or "have" used in this specification may include the corresponding components unless explicitly described to the contrary and therefore, do not preclude other components but further include the components. In addition, unless defined otherwise in the detailed description, all the terms including technical and scientific terms have the same meaning as meanings generally understood by those skilled in the art to which the present invention pertains. Generally used terms such as terms defined in a dictionary should be interpreted as the same meanings as meanings within a context of the related art and should not be interpreted as ideally or excessively formal meanings unless clearly defined in the present specification.

The spirit of the present invention has been just exemplified. It will be appreciated by those skilled in the art that various modifications and alterations can be made without departing from the essential characteristics of the present invention. Accordingly, the exemplary embodiments disclosed in the present invention do not limit but describe the spirit of the present invention, and the scope of the present invention is not limited by the exemplary embodiments. The scope of the present invention should be interpreted by the following claims and it should be interpreted that all spirits equivalent to the following claims fall within the scope of the present invention.

The invention claimed is:

1. A method for managing an item lottery service, the managing method implemented in a computer comprising a processor and a memory coupled with the processor, comprising:

displaying by the processor, using a lottery apparatus display unit, at least one item lottery apparatus for drawing lots for at least one item among usable items in an online game on one part of an item lottery service screen of a user terminal;

displaying by the processor, using an information screen display unit, an information screen with information regarding the usage of the item lottery service on a part of the item lottery service screen, other than a part where the item lottery apparatus is displayed;

sensing by the processor a usage input of at least one drawing of a lot from the user terminal for any one of the at least one item lottery apparatus; and displaying by the processor, within the information screen, using the information screen display unit, information of at least one item determined as being won, according to the usage input, from among at least one winnable item from any one item lottery apparatus, wherein ranking information predetermined according to an item effect is set in at least one item determined as being won in each of the at least one item lottery apparatus.

2. The managing method of claim 1, wherein the displaying by the processor of the at least one item lottery apparatus comprises displaying identification information related to a representative item having the highest ranking among the at least one item that is winnable in each item lottery apparatus on a representative item display screen provided at the each item lottery apparatus.

3. The managing method of claim 1, wherein the displaying by the processor of the at least one item lottery apparatus comprises displaying information related to a remaining available number of the lots at a part of a display region of the at least one item lottery apparatus until the item lottery apparatus is reset for each of the at least one item lottery apparatus.

4. The managing method of claim 1, wherein the sensing by the processor of the usage input includes updating number information of lottery items held by a user as a number obtained by deducting a number of the lots for items by the user from a number of the available lottery items held by the user.

5. The managing method of claim 4, wherein the sensing by the processor of the usage input includes updating number information of the lottery items held by the user as a number obtained by deducting a number of the lots for items by the user from a number obtained by adding a number of free lottery items that are supplied to the user by a predetermined number at every a period, into the number of the lottery items held by the user.

6. The managing method of claim 1, wherein the displaying by the processor of the information within the information screen includes displaying information of at least one item determined as being won per item lottery result corresponding to a number of the lots included in one usage input within the information screen along therewith.

7. The managing method of claim 1, further comprising displaying by the processor an item information display menu at a part of a display region of each item lottery apparatus for each of the at least one item lottery apparatus.

8. The managing method of claim 7, further comprising:

receiving by the processor a selection input for the item information display menu from the user terminal; and displaying by the processor a pop-up screen with identification information of an item that is winnable in an item lottery apparatus including the item information display menu to which the selection input is applied.

9. The managing method of claim 1, further comprising registering by the processor the at least one item determined as being won in a holding item database of a user.

10. An apparatus for managing an item lottery service, the managing apparatus comprising:

a lottery apparatus display unit configured to display at least one item lottery apparatus for drawing lots for at least one item among usable items in an online game on one part of an item lottery service screen of a user terminal;

a lottery input sensor configured to sense a usage input of at least one drawing of a lot from the user terminal for any one of the at least one item lottery apparatus;

a winning determiner configured to determine a winning result of at least one item that is winnable in the any one item lottery apparatus by performing item lottery by as many as the number of the lots;

a winning information generator configured to generate information of at least one item determined as being won based on the winning result; and an information screen display unit configured to display the information of the at least one item determined as being won at a part of the item lottery service screen, other than a part where the item lottery apparatus is displayed, wherein ranking information predetermined according to an item effect is set in at least one item determined as being won in each of the at least one item lottery apparatus.

11. The managing apparatus of claim 10, wherein the information screen display unit displays the information of the at least one item determined as being won on the information screen in the order of higher ranking.

12. The managing apparatus of claim 10, wherein the information screen display unit displays identification information and ranking information related to an item having the highest ranking among at least one kind of item determined as being won at a part of the information screen, and the identification related to the item having the highest ranking is different from that of items other than the item having the highest ranking.

13. The managing apparatus of claim 10, wherein the information screen display unit, when an item having a predetermined ranking range is determined as being won, displays a pop-up screen with winning information of the item having the predetermined ranking range.

14. The managing apparatus of claim 10, wherein the lottery apparatus display unit displays, at a part of a region at which each item lottery apparatus is displayed, identification information of an item having the highest ranking among at one item that is winnable in each of the item lottery apparatus.

15. The managing apparatus of claim 10, wherein the lottery input sensor updates number information of lottery items held by a user as a number obtained by deducting a number of the lots for items by the user from a number of the available lottery items held by the user.

16. The managing apparatus of claim 15, wherein the lottery input sensor updates number information of the lottery items held by the user as a number obtained by deducting a number of the lots for items by the user from a number obtained by adding a number of free lottery items that are supplied to the user by a predetermined number at every a period, into the number of the lottery items held by the user.

17. The managing apparatus of claim 10, wherein the lottery apparatus display unit displays an item information display menu at a part of a display region of each item lottery apparatus for each of the at least one item lottery apparatus.

18. The managing apparatus of claim 17, wherein the lottery apparatus display unit, when receiving a selection input for the item information display menu from the user terminal, displays a pop-up screen with identification information of an item that is winnable in an item lottery apparatus including the item information display menu to which the selection input is applied.

19. The managing apparatus of claim 10, further comprising an item supply controller configured to register the at least one item determined as being won in a holding item database of a user.

20. A non-transitory computer readable recording medium recorded with a program for executing a method for managing an item lottery service, wherein the managing method includes:

displaying, using a lottery apparatus display unit, at least one item lottery apparatus for drawing lots for at least one item among usable items in an online game on one part of an item lottery service screen of a user terminal;

displaying, using an information screen display unit, an information screen with information regarding the usage of the item lottery service on a part of the item lottery service screen, other than a part where the item lottery apparatus is displayed;

sensing a usage input of at least one drawing of a lot from the user terminal for any one of the at least one item lottery apparatus; and displaying, within the information screen, using the information screen display unit, information of at least one item determined as being won, according to the usage input, from among at least one winnable item from any one item lottery apparatus, wherein ranking information predetermined according to an item effect is set in at least one item determined as being won in each of the at least one item lottery apparatus.

* * * * *